United States Patent [19]

Winters

[11] 3,991,688

[45] Nov. 16, 1976

[54] SECURITY DEVICE

[76] Inventor: Lloyd A. Winters, P.O. Box 131, Benedict, Md. 20612

[22] Filed: Jan. 16, 1975

[21] Appl. No.: 541,451

[52] U.S. Cl. ..... 109/32; 109/20

[51] Int. Cl.[2] ..... G08B 15/02; E05G 1/12

[58] Field of Search ..... 109/20, 29, 32, 2, 25, 109/30, 31, 44

[56] References Cited

UNITED STATES PATENTS

| | | | |
|---|---|---|---|
| 3,500,771 | 3/1970 | Fischer et al. | 109/29 |
| 3,664,276 | 5/1972 | Palumbo et al. | 109/29 |

*Primary Examiner*—Paul R. Gilliam
*Assistant Examiner*—David H. Corbin
*Attorney, Agent, or Firm*—Gardiner, Sixbey, Bradford & Carlson

[57] ABSTRACT

A security device consisting of a box-like container having a discharge opening extending through one face thereof and which may be attached to a door or window of a residence or office, or to or adjacent an area which would be attractive to unauthorized persons, said box-like container has therein a removable and replaceable cartridge containing a disabling gas such as tear gas or the like, or a liquid dye of a particular color, or a potent distinctively smelling gas or liquid to be discharged at an unauthorized person. A key actuated locking means is provided for releasing a spring-actuated mechanism which, when released, fires said cartridge and discharges the contents of said cartridge through a discharge opening in said box-like container and through an aligned opening in the mounting means toward any unauthorized person; the key may be inserted within said lock and actuated at said box-like container, or may be connected by a flexible shaft or the like actuated from a position remote from said box-like container.

9 Claims, 15 Drawing Figures

FIG. 7
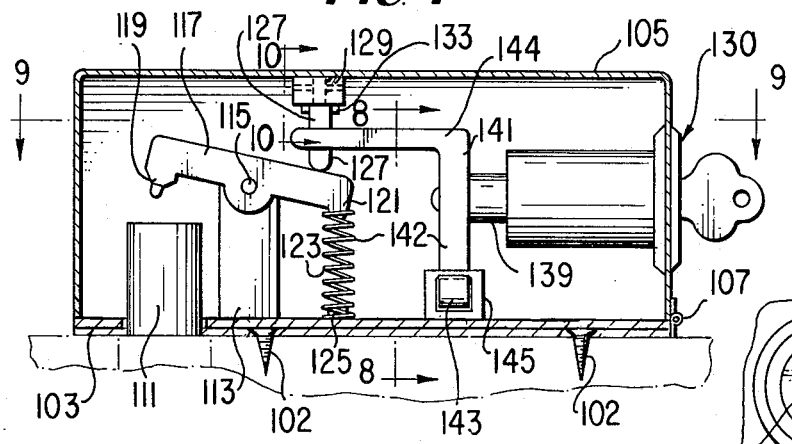
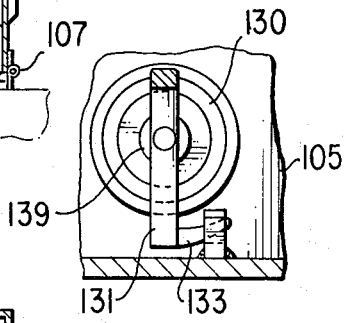
FIG. 8
FIG. 9
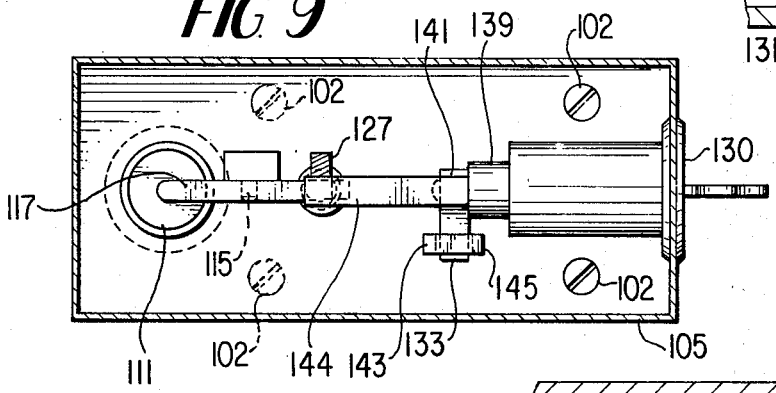
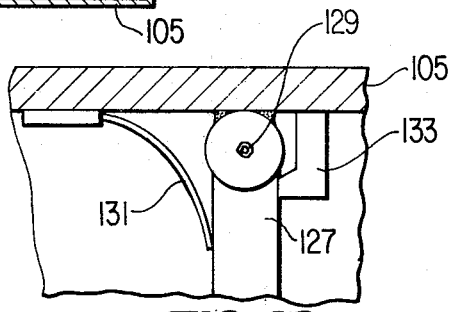
FIG. 10
FIG. 11
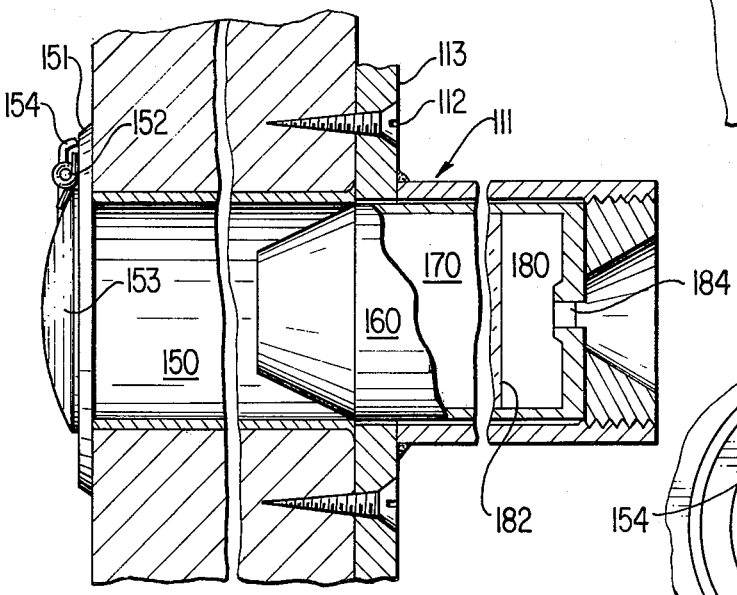
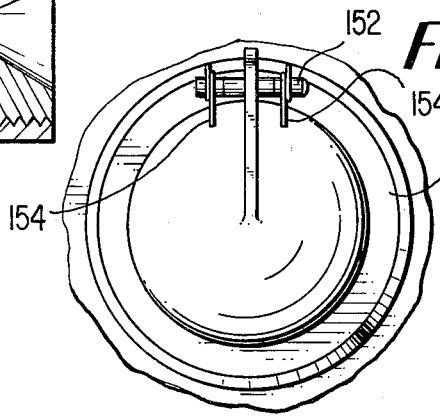
FIG. 12

FIG. 14
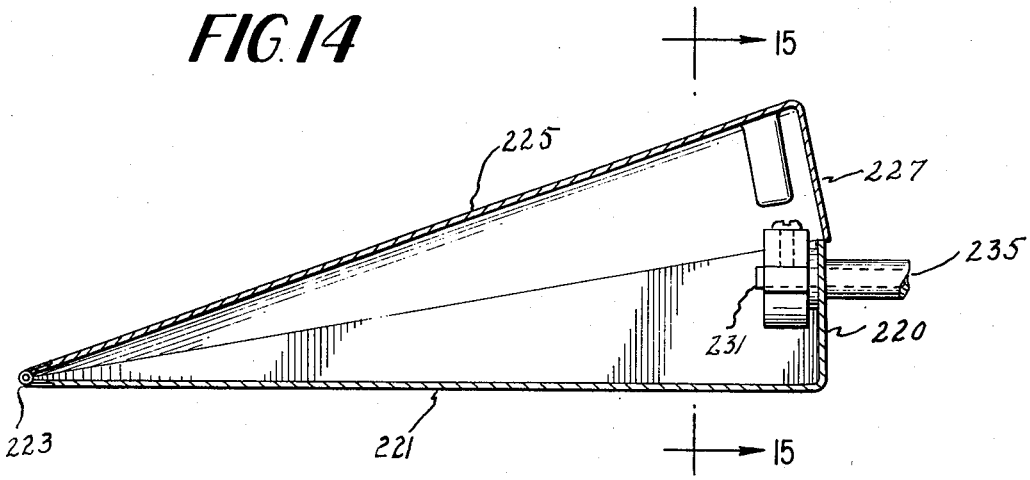
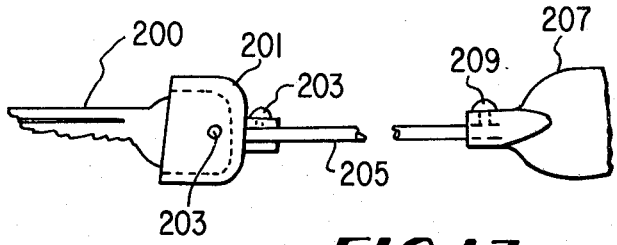
FIG. 15
FIG. 13
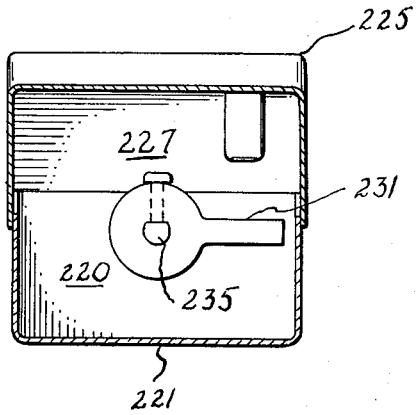

SECURITY DEVICE

SUMMARY OF THE INVENTION

It is the object of the present invention to provide a relatively simple and highly effective protective or security device which serves to prevent an unauthorized person from entering through a door or window of a residence or office or robbing a custodian of a cash register, a bank teller, or the custodian of a money drawer, or the like, by spraying upon such unauthorized person or robber a disabling gas such as tear gas or the like to temporarily disable such person, or to spray upon such person a liquid of a particular, distinctive color, or a potent distinctively smelling gas or liquid which will readily identify such person for pickup by the police or other law-enforcing agency in the event that said person attempts to escape from the scene of unlawful action.

It is a further object of the present invention to provide a security device for retarding, disabling or identifying an unauthorized intruder, which device may be moved within a box-like container comprising front, rear, side and end walls which front walls may be attached to the inside surface of a door or window, and which front wall has mounted thereon a removable and replaceable cartridge, and mechanism such as a spring-actuated firing pin for firing said cartridge under control of a key-actuated lock mechanism, the said rear, side and end walls being integral and being hingedly connected to said front wall whereby they may be moved as a unit about their pivotal mounting to open said box-like container to permit replacement of a discharged cartridge and a resetting of said firing pin mechanism.

It is a further object of the present invention to provide a tubular emission director for insertion within the hole or opening cut through the door or window in alignment with the discharge end of the cartridge contained within said device, the outer end of said tubular emission director having a flap or cover pivotally mounted thereon which is axially and angularly adjustable and retained in its adjusted position to control the direction of discharge of said gas or liquid from said cartridge. Said flap or cover may be spring pressed to normally closed position by a relatively light spring, the tension of which is considerably less than the discharge pressure provided from the cartridge whereby the contents thereof will automatically open said cover when said cartridge is discharged.

These and other objects of the present invention will be readily apparent from the following description of the construction and operation of the several forms of the present invention and consideration of the accompanying drawings wherein:

FIG. 1 is a view of one form of the present invention mounted on the inside surface of an entrance door, FIG. 2 is a horizontal transverse sectional view of one form of the present invention taken along the line 2—2 of FIG. 1 showing the actuating mechanism in its normal inoperative position, FIG. 3 is a sectional view taken along the line 3—3 of FIG. 2, FIG. 4 is a horizontal transverse sectional view taken along the line 4—4 of FIG. 2 and again showing the firing pin and its actuating mechanism in their inoperative positions, FIG. 5 is a fragmented elevational view showing a modified form of key-actuated release mechanism, FIG. 6 is a view similar to FIG. 4 but showing the mechanism after it has been actuated, FIG. 7 is a sectional view similar to FIG. 4 but illustrating a further form of the mechanism, FIG. 8 is a fragmented elevational view taken along the line 8—8 of FIG. 7.

FIG. 9 is a plan sectional view taken along the line 9-9 of FIG. 8,

FIG. 10 is a fragmented sectional view of the firing pin keeper mechanism disclosed in FIGS. 7 and 9, FIG. 11 is a sectional elevational view through a door or like panel showing the discharge port for the emission substance, while, finally FIG. 12 is a face view of the port shown in FIG. 11, FIG. 13 is a partial schematic view showing a remote control operator means for the protective device.

FIG. 14 is a side view showing a foot operated, remote control operator.

FIG. 15 is a sectional view taken along the line 15-15 of FIG. 14.

DETAILED DESCRIPTION

Figure 1:
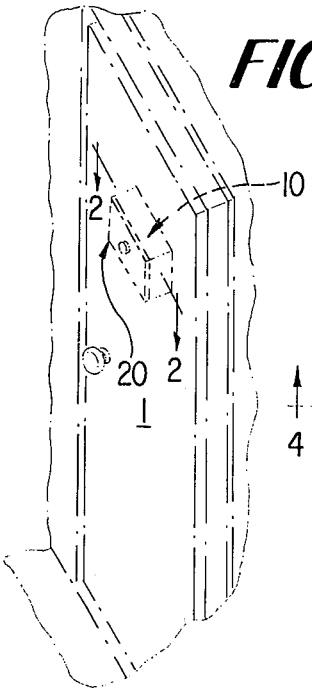
Figure 3:
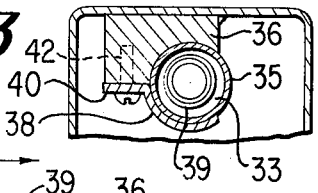

As is self evident from an inspection of FIGS. 1 and 3 in particular, the security device 10 comprises a box-like container having a base plate 3 mounted on the back of a portal, in this case a door 1 by means of conventional screws 2. Hingedly connected to the base plate 3 is a generally rectangular, hollow cover 5 by a conventional, spring hinge 7 to permit access to the operating mechanism of the device. The door or whatever is further provided with a discharge port assembly 20 which is shown in FIGS. 11 and 12 and will be described subsequently. It suffices to say, at this point that the discharge assembly comprises a cylindrical port which is aligned with an emission port provided in base plate 3. Emission port 9 is in communication with a cylindrical cartridge holder 11 in turn mounted on the base plate 3 as by brazing. The interior bore of the cartridge holder 11 is somewhat larger in diameter than is the interior diameter of the discharge port 20 for reasons as will be subsequently apparent. The extreme end 13 of the cartridge holder is threaded to receive a threaded end cap 15 having a conical aperture 17.

Figure 4:
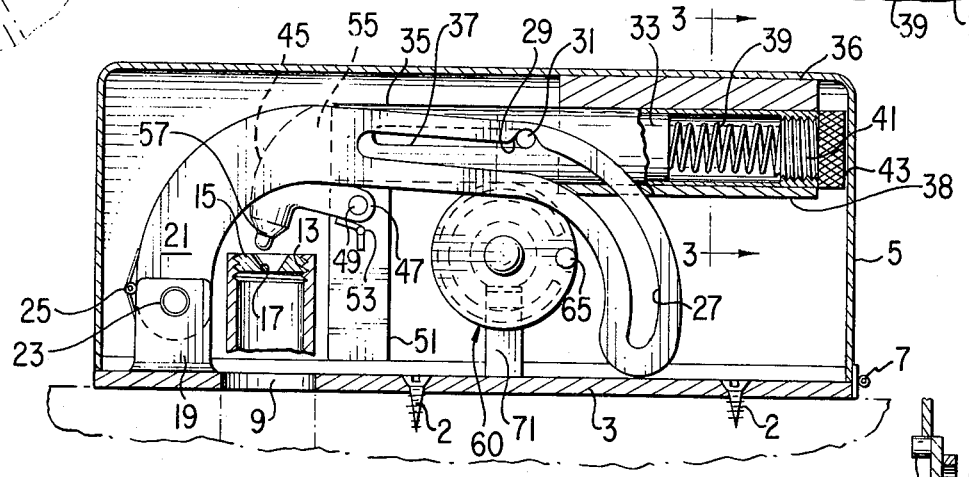

As shown in FIGS. 3 and 4, in particular, the base plate 3 is also provided with an upstanding lug 19 which performs the function, of a journal having pivotally connected thereto a generally arcuate detent lever 21 by pivot pin 23. Also connected between lug 19 and detent lever 21 is a coil spring 25 which biases the lever in a clockwise direction as viewed in FIGS. 4 and 6. Detent lever 21 is provided adjacent its free terminal end with a generally arcuate slot 27. Slot 27 extends along the lever toward the pivoted end thereof for a distance of slightly greater than one-half the overall end-to-end length thereof. At approximately the mid-point of the length of slot 27 there is provided a detent notch 29.

Figure 6:
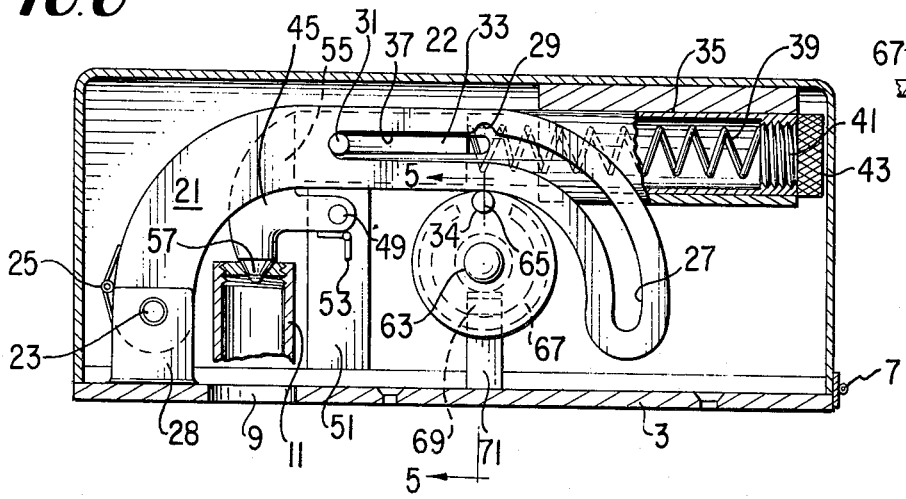

In slidable engagement with said slot and adapted to be held in one position by detent notch 29 is a pin 31 extending outwardly from a cylindrical plunger 33 which can reciprocate in a tubular barrel 35 having a longitudinal slot 37 in which the pin 31 may slide to and fro as the plunger 33 reciprocates in barrel 35. Aside from being engageable with detent notch 29, the pin 31 acts with slot 37 to restrain plunger 33 within the barrel 35 when the plunger moves toward its extreme left-hand position as shown in FIG. 6.

As shown in FIG. 3, barrel 35 is mounted on a saddle block 36 fixed to cover 5 and retained seated therein by an arcuate clamp 38 having a flat land portion 40 which is held against the saddle block 36 by conventional machine screws 42.

Also housed within barrel 35 is a coil spring 39 having one end in abutment with the inner end of plunger 33 and its opposite end in engagement with a restraining plug 41 which is threadedly engaged with the interior of the barrel, as shown, and which, in turn, is provided with a knurled surfaced, finger knob 43.

Figure 2:
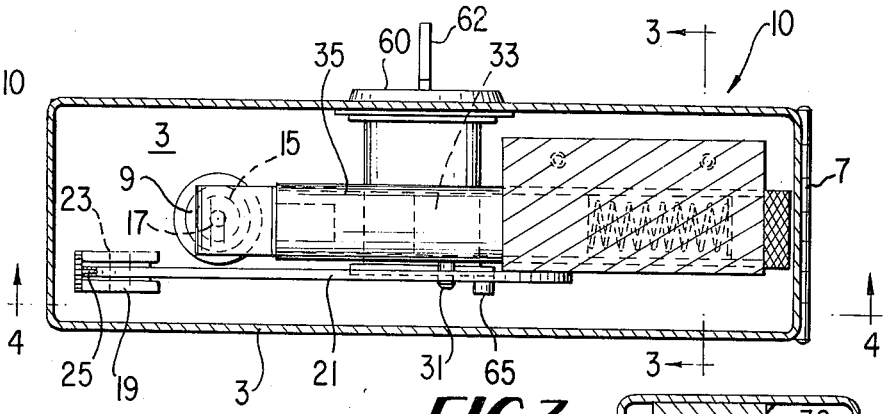

Positioned adjacent the open or right-hand end of barrel 35 as shown in FIGS. 2, 3 and 4, is a general T-shaped firing hammer 45. Firing hammer 45 has its base leg or stem 47 pivotally connected by pivot pin 49 to a bracket 51 and is biased clockwise by a spring 53. The cross bar of the firing hammer 45 terminates in one end in an impact anvil 55 biased into contact with the open end of barrel 35 and the opposite end of the cross bar defines a cone-shaped impact firing pin 57 which mates with the cone-shaped opening 17 of cartridge holder 11 as will be described subsequently.

Figure 5:
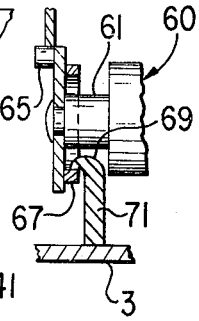

Disposed immediately below the detent lever 21 is a conventional key-operated lock 60 which is conventionally mounted in the side wall of housing 5 as clearly shown in FIG. 2. The lock cylinder 61, see FIG. 4, i.e., that portion which is turned with key 62 extends inwardly beneath detent lever 21 and has affixed thereto a detent disc 63. The detent disc 63 carries on one face a laterally outwardly projecting detent pin 65 and on its opposite face an interrupted cylindrical flange 67. As shown in FIG. 5 in particular, the cylindrical flange 67 underlies the cooperating lip 69 of locking lug 71 mounted on base 3 by any suitable means.

Preferably, but not necessarily, the detent pin 65 is positioned on one side of the detent disc in axial alignment with the gap provided in the cylindrical flange 67.

OPERATION

Considering particularly FIGS. 4 and 6, it will be seen that the key 62 is inserted in lock 60 and the lock is rotated until the gap in the cylindrical flange 67 aligns with the inturned lip 69 of locking lug 71. The cover 5 may then be swung open about hinge 7 to provide access to the mechanism, the lever 21 pivoting about pivot pin 23.

A suitable cartridge containing an explosive, as will be described later, and the deterrent substance, be it tear gas or an identification dye or whatever is inserted in cartridge holder 11. The plunger 33 is forced back against spring 39 in the barrel 35 until pin 31 engages notch 29 in the detent lever 21. The action of springs 25 and 53 keep the detent lever in engagement with pin 31 and also biases the firing hammer 45 toward the end of barrel 35. The device is thus cocked for action and the cover 5 is swung closed. The key is turned to re-engage the cylindrical land 67 with lug 71 to preclude access by unauthorized persons to the operating mechanism.

Should the need arise, such as circumstances presented by an attempted robbery, the key 62 is turned until pin 65 strikes detent lever 21 lifting same to free pin 31 whereupon the plunger 33 is propelled rapidly in barrel 35 to strike the anvil end 55 of firing hammer 45 dirving the conical firing pin end into the apertured cartridge holder 17 with the result that the cartridge containing the disabling or deterrent substance fires and its contents are discharged out of emissions port 20 to douse the illegally acting person and terminate his or her unauthorized actions.

Another form of the device is illustrated in FIGS. 7 through 10. In this case base plate 103 is affixed to the portal or wall by screws 102. cover 105 is hinged to base plate 103 by hinge 107.

Base plate 103 contains cartridge holder 111 which is similar to that previously described.

Disposed above cartridge holder 111 and pivoted on a vertical standard 113 by pin 115 is a rockable lever 117 mounted on a cross strap 104. One end 119 of lever 117 defines a downwardly projecting firing pin aligned with cartridge holder 11 so as to impact and actuate a cartridge therein. The opposite end of rockable lever 117 is comprised of a downwardly projecting tongue 121 which engages and projects interiorly into a coil spring 123 having its lower end surrounding a positioning button 125 which is fixed to cross strap 104 and serves to keep the spring in proper alignment with lever 117. Obviously, as shown in FIG. 7, the lever 117 is biased in a counterclockwise direction by spring 123.

Disposed directly over the spring contacting side of lever 117, intermediate pivot pin 115 and tongue 121, is a vertically depending, detent 127, see FIG. 10 which is pivoted by hinge pin 129 to the side face of cover 105. A leaf spring 131 bears against the swingable detent 127 to bias it against a detent stop 133 as is clearly shown in the noted drawing. Thus, the swingable detent is releasably held in its normal position with respect to cover 105, in which position it bears against lever 117 to hold it against the action of spring 123 and its firing pin end above cartridge holder 111.

Again there is provided a conventional key-operated rotary lock assembly 130 suitably mounted in one end of cover 105. The rotatable operator 139 of lock 130 has affixed to its end an L-shaped trigger member 141 one leg 142 of which is provided with a latching tongue 143. Latching tongue 143 engages an upstanding latching bridge 145 fired to base 103 and thus precludes opening of cover 105 when the trigger member is rotated in a counterclockwise locked position as shown in FIG. 8.

As shown in FIGS. 7 and 8, the other leg 144 of the L-shaped trigger member 141 is positioned adjacent to the swingable detent 127 so that upon further rotation of lock 130 beyond cover latching position as shown in FIG. 8, the leg 144 will move the detent 127 against the bias of spring 131 to release the rockable lever for counterclockwise rotation under the bias of spring 123 to fire a cartridge in cartridge holder 111.

It is believed that the operation of this modification of the deterrent device is apparent from the foregoing description. It should be noted, however, that the bias of spring 131 against detent 127 is of sufficient force to prevent easy turning of lock 130 in the wrong direction when the cover is to be opened. When the lock 130 is turned to open the cover, the biasing spring 123 and lever 117 arelifted with the cover so that the device will not discharge accidientally. Further when the cover latch is operated to release the cover for opening the operator will hold the cover to prevent its flying open under the bias of spring 123 so that the firing pin will gently be biased against cartridge holder 111 and any cartridge therein that may not have been fixed will not be accidentally discharged.

Turning now to FIG. 11, consideration will now be given to the emission port 20 which is inserted through the portal, wall or whatever structure on which the device is mounted. This same port structure is used in conjunction with either form of the device.

As shown the port includes a hollow door inserted cylinder 150 having an internal diameter just slightly less than the diameter of cartridge holder 111 and also the cartridge per se. The outer or exit end of the port has provided thereon a wide annular flange 151 which serves to prevent the port from being pushed out of the portal or wall structure and, at the same time, serves as a mounting base for a hinge 152. Hinge 152 is operatively connected to a trap door 153 which is biased to a closed position by spring 154 forming a part of the hinge structure. The trap door is preferably of very smooth configuration to preclude against its being opened from the outside and to that end the closing bias of spring 154 is calibrated so that the force required to open the door is just at or slightly below the forces generated by firing of a cartridge.

The cartridge 160 itself is more or less of conventional design and operation having a hollow interior filled at its discharge end with the desired emission material 170 behind which there is an explosive charge 180 behind some readily frangible partition 182. Ignition of charge 180 is by striking a percussion button 184 with a firing pin as is quite well known in the explosive and ammunition arts.

The discharge end 161 of cartridge 160, however, is cone shaped and formed of a material that will readily rupture to discharge the contents 170 when charge 180 is exploded. In order to prevent the entire cartridge from exiting from port 20 however, the juncture edge 162 between the cone shaped end 161 and the outer circumferential wall of the cartridge bears against the inner end or lip of the cylindrical door insert 150 to retain the body of the cartridge in place with it is fired as the conical end ruptures to discharge the contents 170.

In some instances, it may not be desirable to physically approach a security device of the types described to insert the key for actuation. Thus, to enable remote operation from some distance such as several feet, the operator key 200, as shown in FIG. 13, may be housed within a rectangular socket member 201 and held in place by a pin lock 203. The remote end of socket member 201 is reduced to cylindrical form and has a set screw 203 into which is fitted an end of a rod-like torque member 205. Member 205 may ideally be fabricated of a fairly rigid cable such as speedometer cable or the like. The free end of cable 205 is inserted within the terminal connector end of a generally fanshaped manipulator element 207 and is securely held in place by a set screw 209. Thus, an operator of the security device may operate same from a position removed therefrom while at the same time the safety of key operation, against accidental discharge of the device, is maintained.

In FIGS. 14 and 15 there is disclosed a foot operated remote control operator consisting of a floor plate 221 connected by a spring hinge 223 to a depressable foot activated treadle plate 225. The treadle plate 225 is provided with a slotted dependent skirt 227 which move down behind the vertical wall 220 of foot plate 221. The edge of skirt 227 engages a rotatable lug 231 mounted in the end wall, of foot plate 221. The lug is connected to a suitable rotary motion transmission cable 235 so as to rotate same when the treadle plate 225 is depressed. Cable 235 may be connected in turn to a key in the manner shown in FIG. 13.

Having described the security device in detail, it will be apparent that various modifications might occur to those skilled in the art, which modifications are within the spirit and scope of the inventive concept defined by the appended claims, wherein:

What is claimed is:

1. A manually operable device for discharging a deterrent substance on persons engaged in unauthorized acts in close proximity to said device, comprising a base plate adapted to be mounted in a vertical position on a support means adjacent the area to be protected;

a key lock housing on said base plate covering said plate, said plate having a discharge opening therethrough;

a cartridge holder including an emission port in alignment with said opening through said base plate;

a cartridge containing an explosive charge and a deterrent substance fitted in said holder;

manually operable means for discharging said cartridge, said means comprising a pivoted cartridge impact member, spring means for actuating said impact member to fire said cartridge;

detent means operable to retain the spring means under compression;

a rotary, key-operated means engageable with said detent means and operable to release said detent means when a key is inserted and rotated therein, in one direction, and, further, in engagement with said cover to retain said cover closed when said spring is compressed and during release of said detent means, said key operated means being rotatable in the opposite direction to release said cover.

2. A security device as set forth in claim 1 wherein said cartridge firing means comprises a spring-biased rockable lever havingone leg adapted to fire said cartridge, and spring means acting on the opposite leg thereof; and said detent means comprises a pivoted detent lever biased in contact with the lever opposite the spring contacted side thereof said key operated means contacting said detent means to pivot same out of contact with said rockable lever to fire said cartridge.

3. A security device as claimed in claim 1, wherein said cartridge firing means comprises a pivoted lever including a detent notch; a spring biased plunger having means engageable with said notch to constrain said plunger against the action of said spring bias, a rotatable impact means for contact by said plunger and having means to contact said cartridge upon actuation of said plunger and said key operated rotary means lifts said latching notch free of said plunger constraining means to actuate said device to discharge said cartridge.

4. A security device as defined in claim 1, wherein said cartridge holder is a hollow cylinder opening through the discharge opening provided in said base plate, and said opening is aligned with a tubular emission port extending through a portal, partition or the like mounting means, said emission port having an internal diameter such as to confine a cartridge in said cartridge holder so that only the contents of said cartridge discharge through said emission port.

5. A security device as defined in claim 4, wherein said emission port is provided with a spring-biased cover openable primarily only in response to discharge of said cartridge.

6. A security device as defined in claim 1, wherein said cartridge contains an explosive charge and an irritant substance such as tear gas for discharge therefrom.

7. A security device as defined in claim 1, wherein said cartridge contains an explosive charge and a marking substance such as a dyestuff or the like.

8. A security device as defined in claim 1, wherein said cartridge contains an explosive charge and an unpleasantly odoriferous substance.

9. A security device as defined in claim 1, wherein said key-operated operator includes a removable key and further including remote operable means connected to said key to permit operation of the device from a remote location.

* * * * *